US008944868B2

(12) United States Patent
Kanno

(10) Patent No.: US 8,944,868 B2
(45) Date of Patent: Feb. 3, 2015

(54) OUTBOARD MOTOR

(71) Applicant: Yamaha Hatsudoki Kabushiki Kaisha, Iwata-shi, Shizouka (JP)

(72) Inventor: Isao Kanno, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 153 days.

(21) Appl. No.: 13/889,430

(22) Filed: May 8, 2013

(65) Prior Publication Data

US 2014/0030939 A1 Jan. 30, 2014

(30) Foreign Application Priority Data

Jul. 30, 2012 (JP) ..... 2012-168084

(51) Int. Cl.
*B63H 20/10* (2006.01)
*B63H 20/00* (2006.01)

(52) U.S. Cl.
CPC ..... *B63H 20/10* (2013.01); *B63H 2020/003* (2013.01)
USPC ..... 440/53; 440/1; 440/61 T

(58) Field of Classification Search
USPC ..... 440/1, 53, 61 D, 61 R, 61 T; 114/144 R
See application file for complete search history.

(56) References Cited

U.S. PATENT DOCUMENTS 4,824,407 A * 4/1989 Torigai et al. ..... 440/1
4,898,563 A * 2/1990 Torigai et al. ..... 440/1
6,994,046 B2 * 2/2006 Kaji et al. ..... 440/53
2009/0224132 A1 9/2009 Mochizuki

FOREIGN PATENT DOCUMENTS

JP 2009-208654 A 9/2009

* cited by examiner

*Primary Examiner* — Lars A Olson
(74) *Attorney, Agent, or Firm* — Keating & Bennett, LLP

(57) ABSTRACT

An outboard motor attached to a hull includes a body, a body driving device, and a control device. The body includes an engine and a propeller shaft. The propeller shaft is configured to be rotated by a drive force from the engine. The body is configured to pivot about a tilt axis extending in a lateral direction of the hull. The body driving device is configured to drive the body about the tilt axis. The control device is programmed to control the body driving device so that a rear end of the propeller shaft is positioned higher than a front end of the propeller shaft when the control device determines that the propeller shaft is to rotate in a direction in which the hull is propelled in reverse.

8 Claims, 6 Drawing Sheets

OUTBOARD MOTOR

BACKGROUND OF THE INVENTION

1. Field of the Invention

The present invention relates to an outboard motor.

2. Description of the Related Art

Conventionally, watercrafts provided with an outboard motor attached to a rear end portion of a hull are widely known. Such watercrafts are capable of moving forwards or in reverse by switching the direction of rotation of a propeller provided on the outboard motor (e.g., see JP-A 2009-208654).

Specifically, the watercraft moves forward by causing the rotation of the propeller to produce a rearward water flow, and moves in reverse by causing the rotation of the propeller to produce a forward water flow.

However, the outboard motor according to JP-A 2009-208654 is disposed at a distance, in the rearward direction, from a rear surface of the bottom of the transom.

Therefore, a problem occurs in that during a reverse movement, the forward water flow strikes the rear surface of the bottom of the transom, thus reducing the force propelling the watercraft in the reverse direction.

SUMMARY OF THE INVENTION

Preferred embodiments of the present invention provide an outboard motor in which a forward water flow is prevented from striking the rear surface of the bottom of the transom.

An outboard motor according to a preferred embodiment of the present invention is attached to a hull, and includes a body, a body driving device, and a control device. The body includes, for example, an engine and a propeller shaft. The propeller shaft is configured to be rotated by a drive force from the engine. The body is configured to pivot about a tilt axis extending in a lateral direction of the hull. The body driving device is configured to drive the body about the tilt axis. The control device is programmed to control the body driving device so that a rear end of the propeller shaft is positioned higher than a front end of the propeller shaft when the control device determines that the propeller shaft is to rotate in a direction in which the hull is propelled in reverse.

According to preferred embodiments of the present invention, it is possible to provide an outboard motor in which the forward water flow can be prevented from striking the rear surface of the bottom of the transom.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention will now be described with reference to the accompanying drawings.

Figure 1:
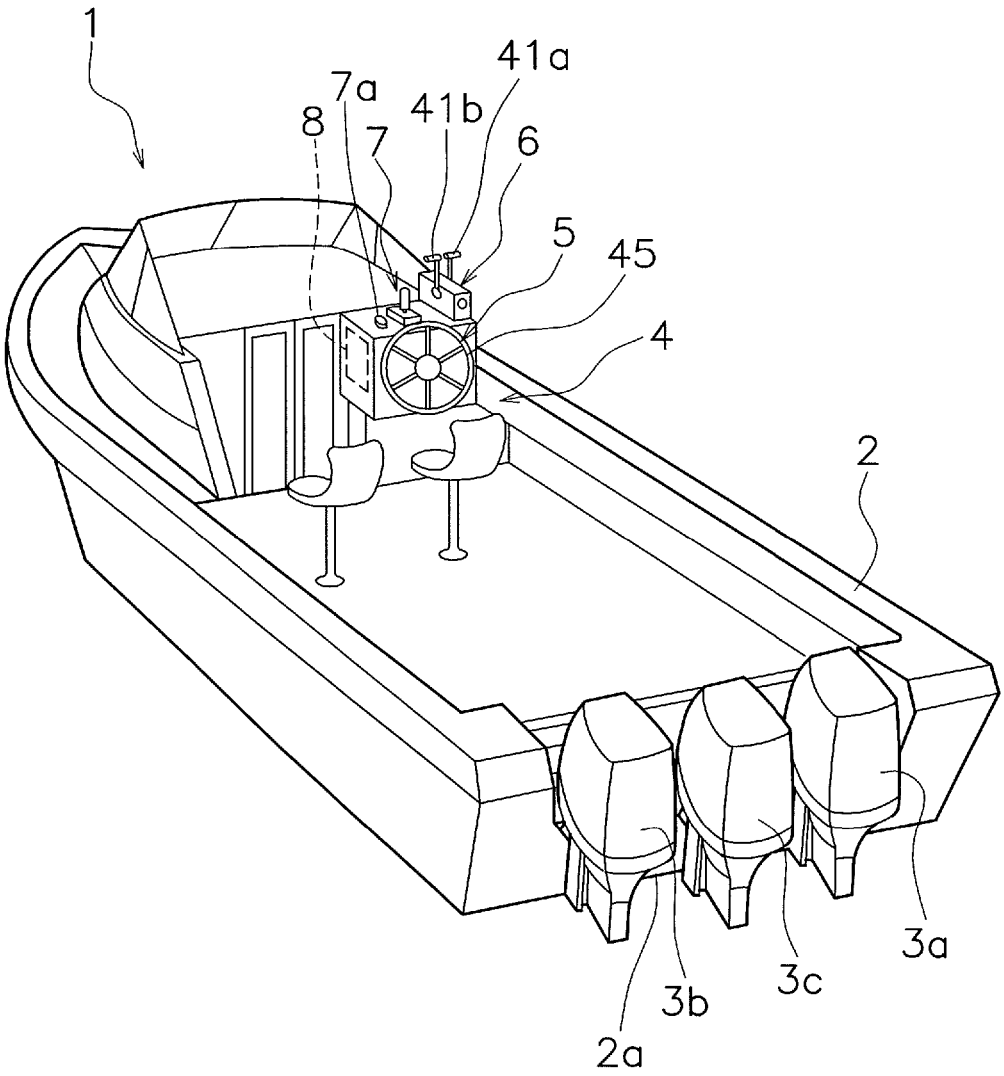
FIG. 1 is a perspective view of a watercraft according to a preferred embodiment of the present invention.

FIG. 1 is a perspective view showing a watercraft 1. As shown in FIG. 1, the watercraft 1 includes a hull 2 and a plurality of outboard motors 3*a* through 3*c*. The watercraft 1 includes a control system. The control system of the watercraft 1 will be described further below.

The outboard motors 3*a* through 3*c* include a starboard outboard motor 3*a* (hereafter referred to as an S-engine 3*a*), a port outboard motor 3*b* (hereafter referred to as a P-engine 3*b*), and a center outboard motor 3*c* (hereafter referred to as a C-engine 3*c*).

The S-engine 3*a*, the P-engine 3*b*, and the C-engine 3*c* (hereafter collectively referred to as the S, P, and C-engines 3*a* through 3*c*) are attached to a transom 2*a* of the hull 2. The S, P, and C-engines 3*a* through 3*c* are arranged along the lateral direction of the hull 2. Specifically, the S-engine 3*a* is disposed on the starboard side of the stern. The P-engine 3*b* is disposed on the port side of the stern. The C-engine 3*c* is disposed at the center of the stern, i.e., between the S-engine 3*a* and the P-engine 3*b*. Each of the S-engine 3*a*, the P-engine 3*b*, and the C-engine 3*c* generates a propelling force to propel the watercraft 1. The configuration of the S, P, and C-engines 3*a* through 3*c* will be described further below.

The hull 2 includes a maneuvering seat 4. A steering device 5, a remote control device 6, a controller 8, and a joystick 7 are disposed at the maneuvering seat 4. The steering device 5 allows the operator to turn the direction of the watercraft 1. The steering device 5 includes a steering member 45. The steering member 45 preferably is, e.g., a handle. The steering member 45 sets the target steering angle of the S, P, and C-engines 3*a* through 3*c*. The remote control device 6 allows the operator to adjust the vessel speed of the watercraft 1. The remote control device 6 allows the operator to switch between forward movement and reverse movement of the hull 2. The joystick 7 allows the operator to select the direction of travel of the watercraft 1 to at least forward, reverse, leftward, and rightward directions. The joystick 7 is activated when a joystick mode button 7*a* is pressed. The controller 8 is programmed to control the outboard motors 3*a* through 3*c* according to operation signals from the steering device 5, the remote control device 6, and the joystick 7.

Figure 2:
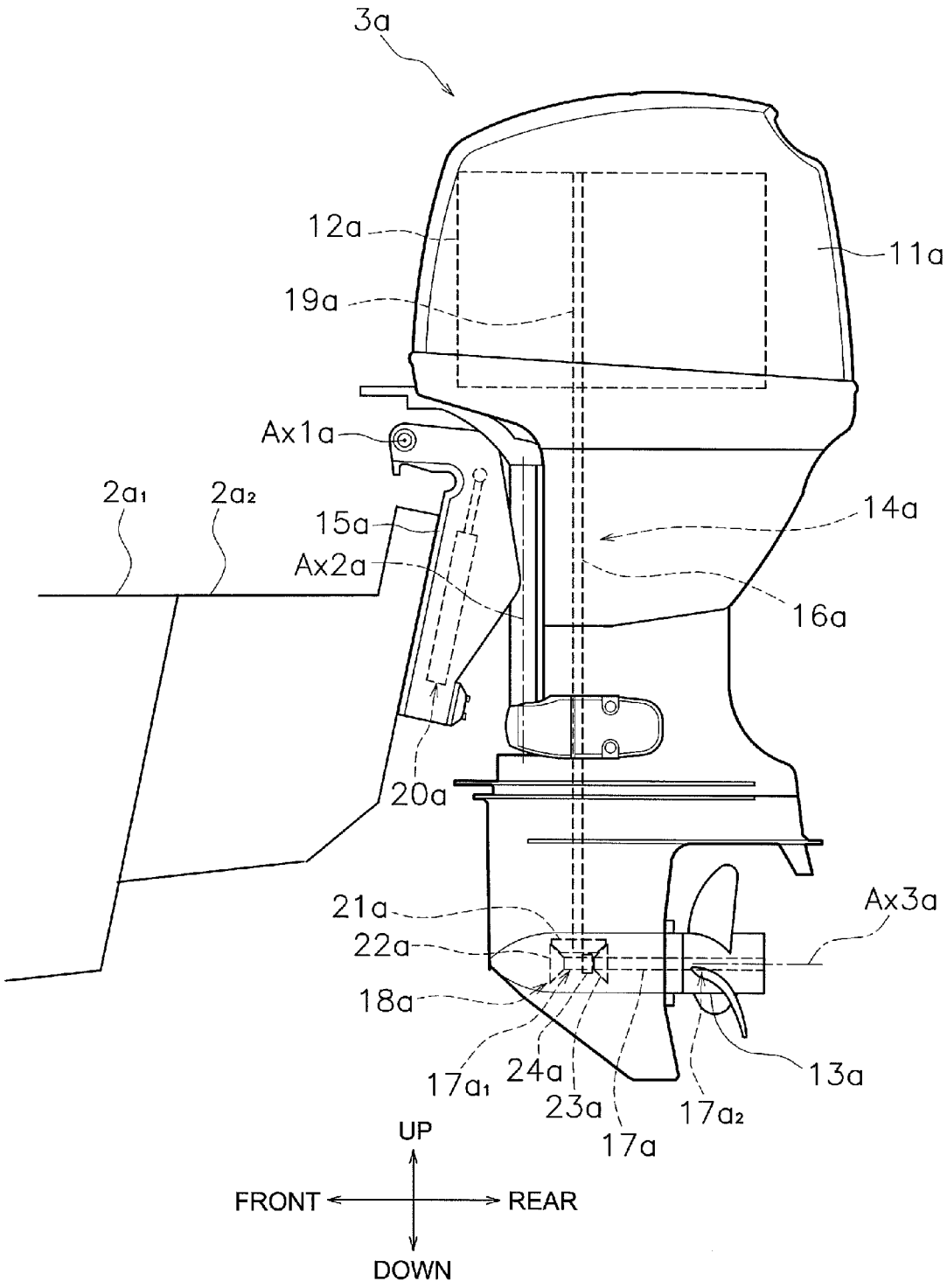
FIG. 2 is a side view of an outboard motor in an instance in which the hull is moving forward.
Figure 3:
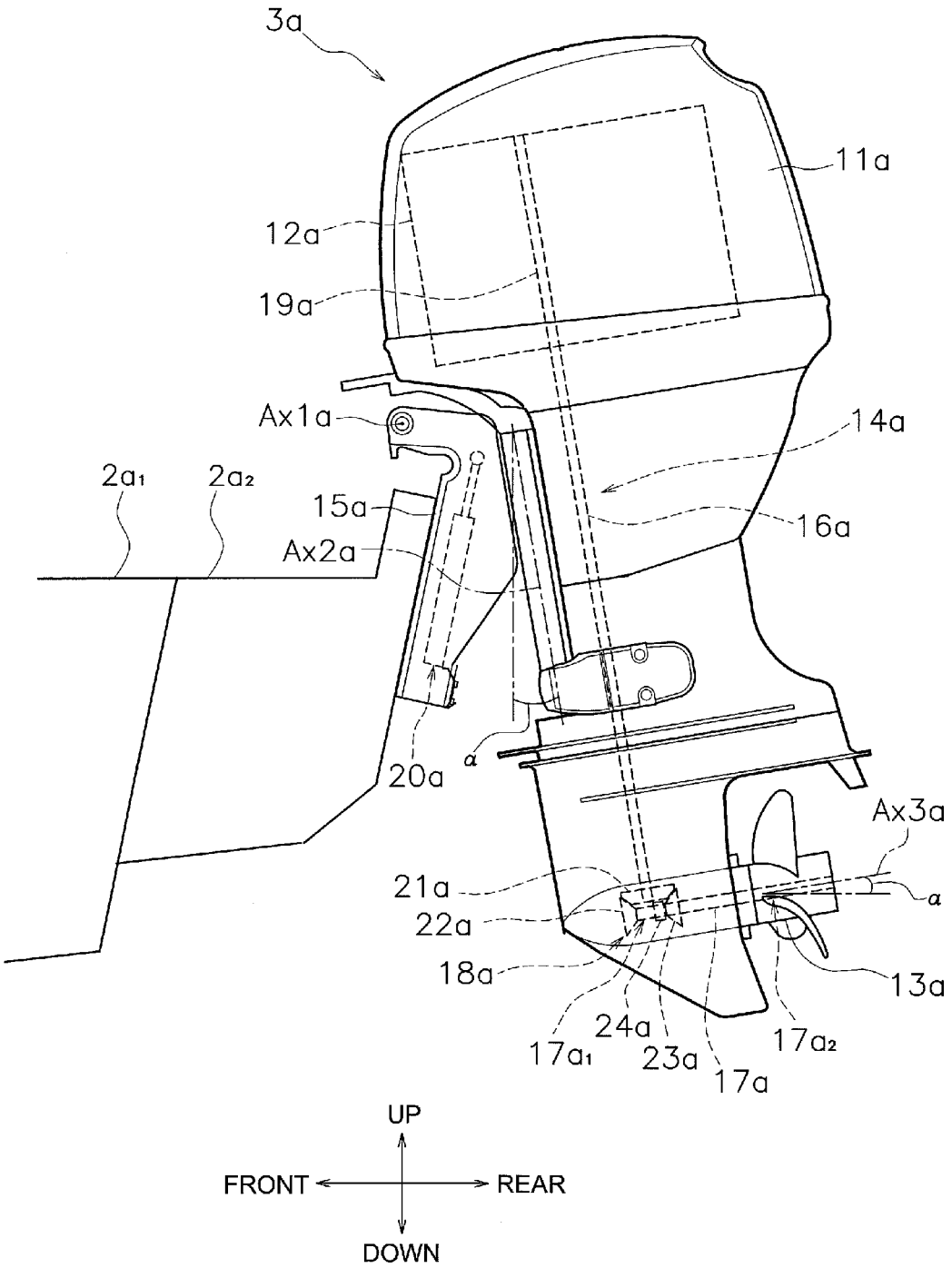
FIG. 3 is a side view of an outboard motor in an instance in which the hull is moving in reverse.

The configuration of each of the P-engine 3*b* and the C-engine 3*c* preferably is identical to the configuration of the S-engine 3*a*; therefore, a description will be given only for the configuration of the S-engine 3*a*. FIGS. 2 and 3 are side views of the S-engine 3*a*. FIG. 2 shows the layout of the S-engine 3*a* in an instance in which the hull 2 is moving forward, and FIG. 3 shows the layout of the S-engine 3*a* in an instance in which the hull 2 is moving in reverse.

The S-engine 3*a* includes a cover member 11*a*, a first engine 12*a*, a propeller 13*a*, a power transmission mechanism 14*a*, a bracket 15*a*, and a first power-tilt-and-trim (PTT) device 20*a*. In the present preferred embodiment, the cover member 11*a*, the first engine 12*a*, and the power transmission mechanism 14*a* configure a "body of the S-engine 3*a*". The first PTT device 20*a* is an example of a "body driving device" that pivotably drives the body of the S-engine 3*a* about a tilt axis Ax1*a* extending in the lateral direction.

The cover member 11*a* accommodates the first engine 12*a* and the power transmission mechanism 14*a*. The first engine 12*a* is disposed in an upper section of the S-engine 3*a*. The propeller 13*a* is disposed on a lower section of the S-engine 3*a*. The propeller 13*a* is rotatably driven by a drive force from the first engine 12*a*, transmitted through the power transmission mechanism 14*a*. The power transmission mechanism 14*a* includes a drive shaft 16*a*, a propeller shaft 17*a*, and a shift mechanism 18*a*.

The drive shaft 16*a* is disposed along the vertical direction. The drive shaft 16*a* is connected to a crank shaft 19*a* of the first engine 12*a*.

The propeller shaft 17*a* is caused to rotate by a drive force from the first engine 12*a*, transmitted via the drive shaft 16*a* and the shift mechanism 18*a*. The shift mechanism 18*a* is secured to a front end portion $17a_1$ of the propeller shaft 17*a*. The propeller 13*a* is secured to a rear end portion $17a_2$ of the propeller shaft 17*a*. The drive force from the first engine 12*a* is transmitted, in sequence, to the propeller 13*a* via the drive shaft 16*a*, the shift mechanism 18*a*, and the propeller shaft 17*a*.

As shown in FIG. 2, in an instance in which the hull 2 is moving forward, the drive shaft 16*a* is parallel or substantially parallel to the vertical direction, and the axial line direction Ax3*a* of the propeller shaft 17*a* is parallel or substantially parallel to the horizontal direction. Therefore, in an instance in which the hull 2 is moving forward, the rotation of the propeller 13*a* generates a directly rearward water flow. In contrast, as shown in FIG. 3, in an instance in which the hull 2 is moving in reverse, the axial line direction Ax3*a* of the propeller shaft 17*a* is tilted with respect to the horizontal direction. The propeller shaft 17*a* is therefore inclined so that the rear end portion $17a_2$ is positioned higher than the front end portion $17a_1$. Therefore, in an instance in which the hull 2 is moving in reverse, the rotation of the propeller 13*a* generates a water flow oriented forwards and diagonally downwards.

Thus, in the present preferred embodiment, in an instance in which the propeller shaft 17*a* rotates in a direction in which the hull 2 is propelled in reverse, a trim angle control is performed so that the rear end portion $17a_2$ of the propeller shaft 17*a* is positioned higher than the front end portion $17a_1$. As shown in FIG. 3, when the trim angle control is being performed, the drive shaft 16*a* defines an angle $\alpha$ with respect to the vertical direction, and the propeller shaft 17*a* defines an angle $\alpha$ with respect to the horizontal direction. The trim angle control will be described in detail further below.

The shift mechanism 18*a* transmits the rotating drive force of the drive shaft 16*a* to the propeller shaft 17*a*. The shift mechanism 18*a* also switches the direction of rotation of power transmitted from the drive shaft 16*a* to the propeller shaft 17*a*. The shift mechanism 18*a* includes, for example, a pinion gear 21*a*, a forward gear 22*a*, a reversing gear 23*a*, and a dog clutch 24*a*. The pinion gear 21*a* is connected to a lower end of the drive shaft 16*a*. The pinion gear 21*a* engages with the forward gear 22*a* and the reversing gear 23*a*. The forward gear 22*a* and the reversing gear 23*a* are capable of rotating relative to the propeller shaft 17*a*. The dog clutch 24*a* is capable of moving, along the axial line direction Ax3*a* of the propeller shaft 17*a*, between a forward propulsion position (see FIG. 2), a reverse propulsion position (see FIG. 3), and a neutral position (not shown). The neutral position is a position between the forward propulsion position and the reverse propulsion position. When the dog clutch 24*a* is positioned at the forward propulsion position, the rotation of the drive shaft 16*a* is transmitted to the propeller shaft 17*a* via the forward gear 22*a*. The propeller 13*a* is thus caused to rotate in a direction in which the hull 2 is caused to move forward. When the dog clutch 24*a* is at the reverse propulsion position, the rotation of the drive shaft 16*a* is transmitted to the propeller shaft 17*a* via the reversing gear 23*a*. The propeller 13*a* is thus caused to rotate in a direction in which the hull 2 is propelled in reverse. In an instance in which the dog clutch 24*a* is at the neutral position, the forward gear 22*a* and the reversing gear 23*a* do not engage with the propeller shaft 17*a*. Accordingly, the drive shaft 16*a* is in a state of running idle, and the propeller shaft 17*a* does not rotate.

The bracket 15*a* attaches the body of the S-engine 3*a* (the cover member 11*a*, the first engine 12*a*, and the power transmission mechanism 14*a*) to the transom 2*a*. Specifically, as shown in FIGS. 2 and 3, the bracket 15*a* is detachably secured to an outer edge of a projecting portion $2a_2$ of the transom 2*a*, the projecting portion $2a_2$ projecting rearwards from a base portion $2a_1$ of the transom 2*a*. The S-engine 3*a* is attached so as to be capable of pivoting vertically about the tilt axis Ax1*a* of the bracket 15*a*. The tilt axis Ax1*a* extends in the lateral direction of the hull 2. The body of the S-engine 3*a* pivots about the tilt axis Ax1*a* such that the trim angle and the tilt angle change. The trim angle and the tilt angle are angles that the drive shaft 16*a* define with the vertical direction. The body of the S-engine 3*a* is attached so as to be capable of pivoting laterally about a steering axis Ax2*a* of the bracket 15*a*. The body of the S-engine 3*a* pivots about the steering axis Ax2*a* such that the steering angle can be changed. The steering angle is an angle that a rotation axial line Ax3*a* of the propeller 13*a* defines with the longitudinal direction.

Figure 4:
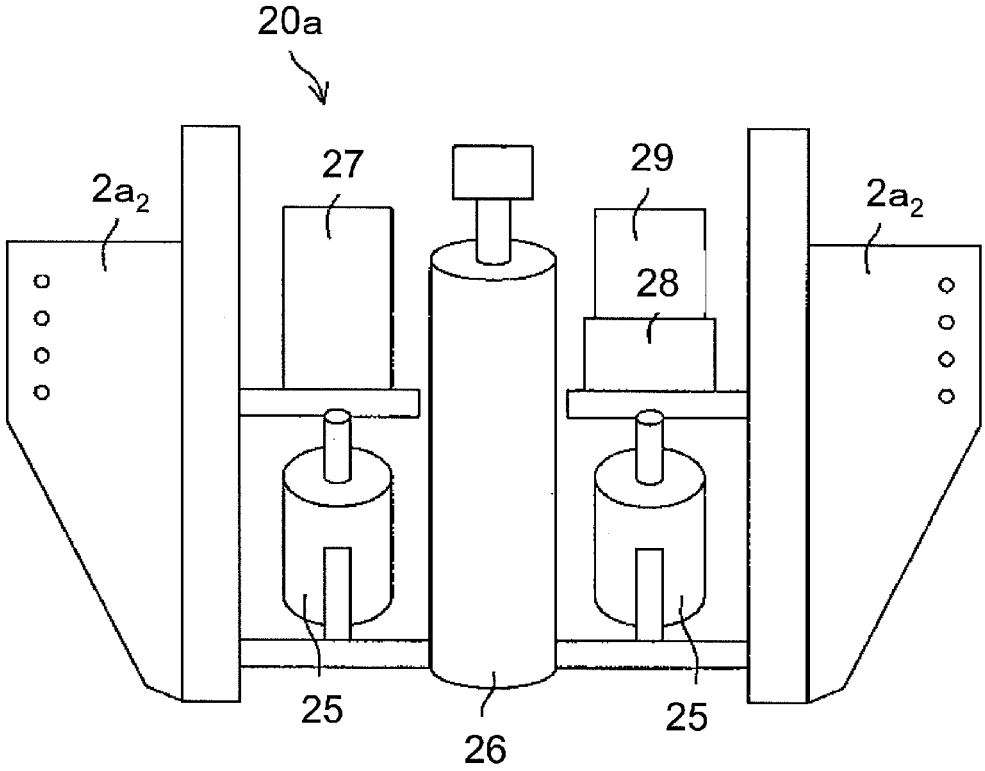
FIG. 4 is a rear view showing the configuration of a first power-tilt-and-trim device.

The first PTT device 20*a* pivotably drives the body of the S-engine 3*a* about the tilt axis Ax1*a*. FIG. 4 is a rear view showing the configuration of the first PTT device 20*a*. As shown in FIG. 4, the first PTT device 20*a* includes, for example, a pair of trim cylinders 25, a tilt cylinder 26, an oil pump 27, an electric motor 28, and a tank 29. The pair of trim cylinders 25 and the tilt cylinder 26 support the body of the S-engine 3*a* until the drive shaft 16*a* defines a maximum trim angle with the vertical direction. The tilt cylinder 26 supports the body of the S-engine 3*a* until the drive shaft 16*a* defines a maximum tilt angle with the vertical direction. The maximum trim angle is larger than angle $\alpha$ (see FIG. 3), and the maximum tilt angle is larger than the maximum trim angle. The oil pump 27 is driven by the electrical power of the electric motor 28, and feeds hydraulic fluid stored in the tank 29 to the pair of trim cylinders 25 and the tilt cylinder 26.

Figure 5:
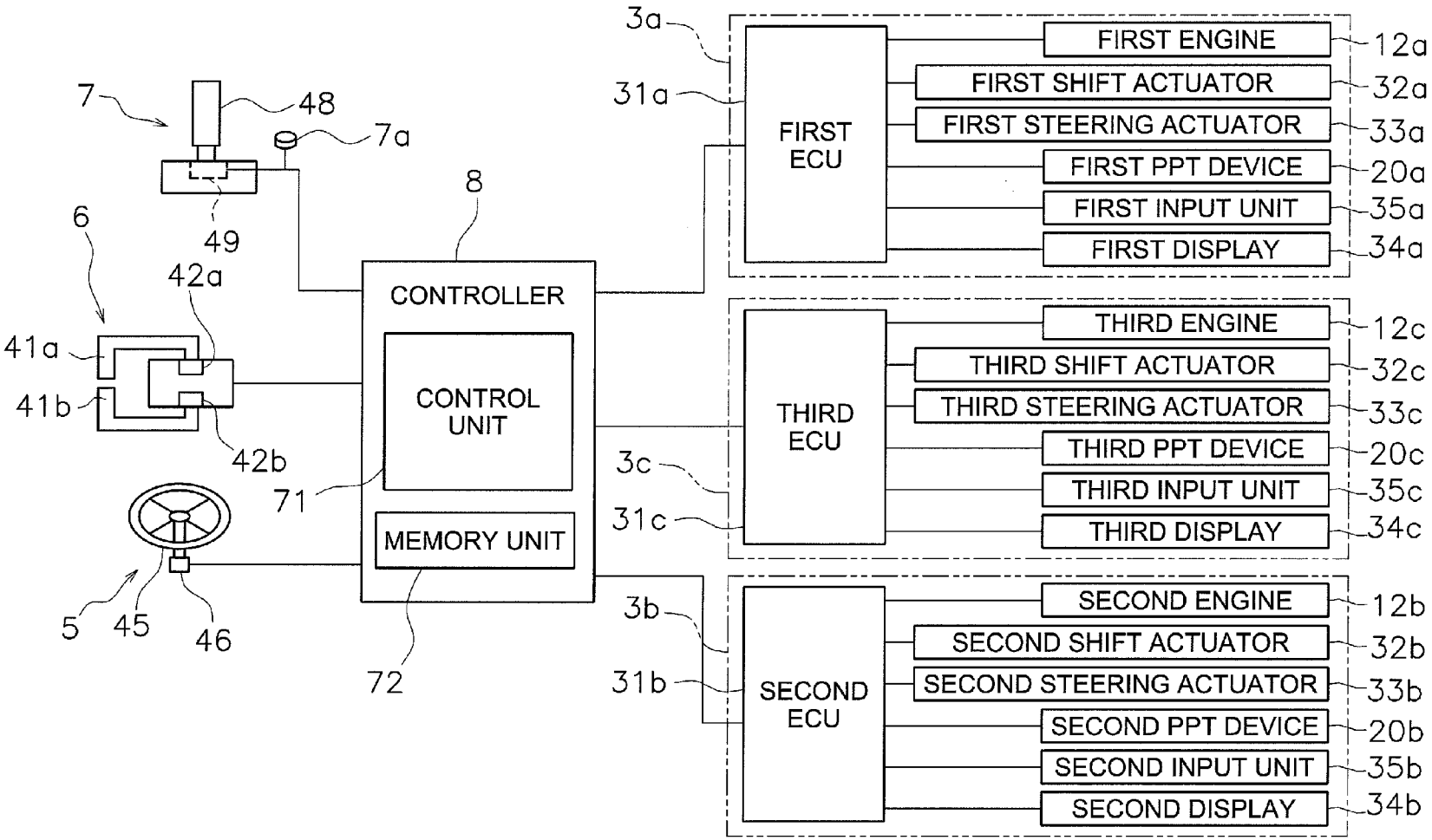
FIG. 5 is a block diagram showing a configuration of a control system.

FIG. 5 is a block diagram showing the configuration of a control system for the watercraft 1. The control system for the watercraft 1 includes the steering device 5, the remote control device 6, the joystick 7, the controller 8, and the S, P, and C-engines 3*a* through 3*c*.

The steering device 5 includes the steering member 45 and a steering position sensor 46. The steering member 45 is, e.g., a handle. The steering member 45 sets the target steering angle of the S, P, and C-engines 3*a* through 3*c*. The steering position sensor 46 detects the operation amount, i.e., the operation angle of the steering member 45. An operation signal from the steering position sensor 46 is sent to the controller 8. Thus, the operator adjusts the direction of motion of the watercraft 1.

The remote control device 6 includes a first operation member 41*a*, a first operation position sensor 42*a*, a second operation member 41*b*, and a second operation position sensor 42*b*. The first operation member 41*a* is, e.g., a lever. The first operation member 41*a* can be tilted in the longitudinal direction. The first operation position sensor 42*a* detects the operation position of the first operation member 41*a*. The first operation position sensor 42*a* sends to the controller 8 an operation signal generated according to the detected operation position of the first operation member 41*a*. The dog clutch 24*a* thus travels to a shift position corresponding to the operation position of the first operation member 41*a*, and the target engine speed of the first engine 12*a* is adjusted to a value corresponding to the operation position of the first operation member 41*a*. The second operation member 41*b* and the second operation position sensor 42*b* include configurations similar to those of the first operation member 41*a* and the first operation position sensor 42*a*. The C-engine 3*c* is switched between forward and reverse movements, and the target engine speed of the C-engine 3*c* is adjusted according to an operation performed on the first operation member 41*a* and the second operation member 41*b*. Specifically, if the shift positions corresponding to the operation positions of the first operation member 41*a* and the second operation member 41*b* match, the dog clutch of the C-engine 3*c* is set to the shift position. The target engine speed of the C-engine 3*c* is set to an average value between the target engine speed of the S-engine 3*a* and the target engine speed of the P-engine 3*b*. If the shift positions corresponding to the operation positions of the first operation member 41*a* and the second operation member 41*b* do not match, the dog clutch of the C-engine 3*c* is set to the neutral position. In such an instance, the target engine speed of the C-engine 3*c* is set to a predetermined idle speed.

The joystick 7 is activated when the joystick mode button 7*a* is pressed. When the joystick mode button 7*a* is pressed, an activation signal is sent to the controller 8. The joystick 7 includes a direction indication member 48 and an operation position sensor 49. The direction indication member 48 preferably has a rod shape, for example, and can be tilted in at least four directions, i.e., forwards, rearwards, leftwards, and rightwards. The joystick 7 may also be capable of indicating more than four directions, and may also be capable of indicating all directions. The direction indication member 48 can also indicate a direction of pivoting. The operation position sensor 49 detects the operation position of the direction indication member 48. The operation position sensor 49 sends to the controller 8 an operation signal generated according to the operation position of the direction indication member 48. The S, P, and C-engines 3*a* through 3*c* are controlled so that the hull 2 travels in parallel or substantially parallel with a direction corresponding to the direction in which the direction indication member 48 has been tilted, or so that the hull 2 pivots in a direction corresponding to the direction in which the direction indication member 48 has been pivoted.

The controller 8 preferably includes a control unit 71 and a memory unit 72. The control unit 71 preferably includes a CPU or any other computation device. The memory unit 72 preferably includes, e.g., a RAM, a ROM, or any other semiconductor memory unit; or a hard disc, a flash memory, or a similar device. The memory unit 72 stores programs and data used to control the S, P, and C-engines 3*a* through 3*c*. The controller 8 sends to the S, P, and C-engines 3*a* through 3*c* a command signal in accordance with the operation signals from the steering device 5, the remote control device 6, and the joystick 7. The command signal includes, e.g., a reverse signal indicating that the hull 2 is to be moved in reverse, and a forward signal indicating that the hull 2 is to be moved forward. The controller 8 also sends to the S, P, and C-engines 3*a* through 3*c* a joystick activation signal in accordance with the activation signal from the joystick mode button 7*a*.

The S-engine 3*a* includes a first electric control unit (ECU) 31*a*, a first shift actuator 32*a*, a first steering actuator 33*a*, a first display 34*a*, a first input unit 35*a*, the first engine 12*a*, and the first PTT device 20*a*.

The first ECU 31*a* is programmed to control the first shift actuator 32*a*, the first steering actuator 33*a*, and the first engine 12*a* on the basis of the command signal from the controller 8 such that the direction of motion of the hull 2 is adjusted, the direction of rotation of the propeller 13*a* is switched, and the speed of rotation of the propeller 13*a* is adjusted on the basis of the operation signals from the steering device 5, the remote control device 6, and/or the joystick 7.

Figure 6:
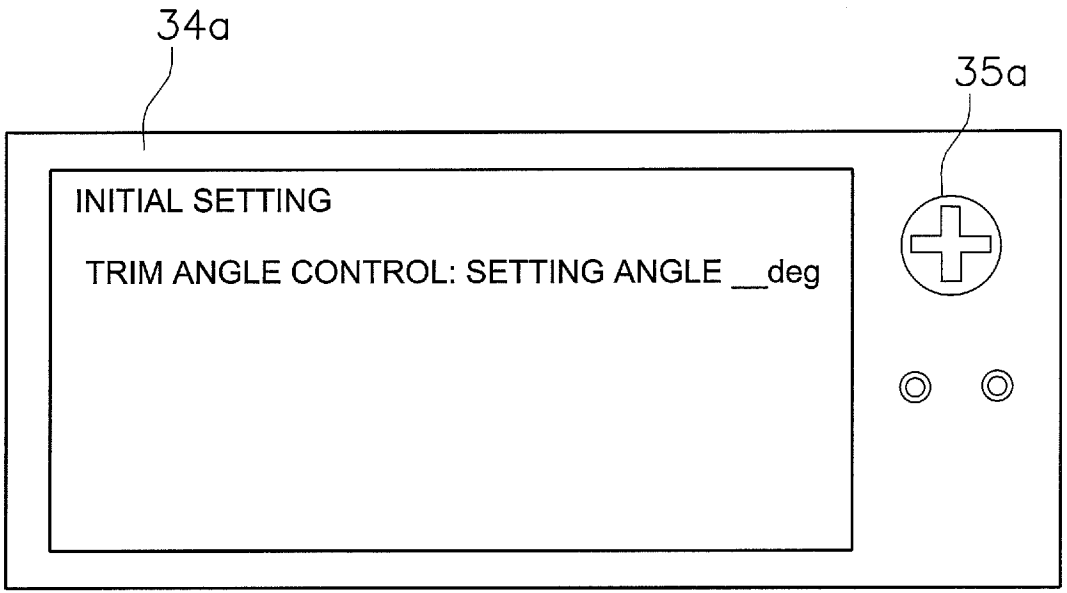
FIG. 6 is a schematic diagram showing an example of an entry screen displayed on a first display.

The first ECU 31*a* is programmed to set the action of the first PTT device 20*a* in an instance in which the hull 2 is propelled in reverse. Specifically, the first ECU 31*a* is programmed to initially cause the first PTT device 20*a* to perform a trim angle control in an instance in which the first ECU 31*a* determines that the propeller shaft 17*a* is to rotate in a direction in which the hull 2 is propelled in reverse. Initial setting of the first ECU 31*a* according to the above description can be programmed in advance by the user when, e.g., the S-engine 3*a* is attached to the hull 2. FIG. 6 is a schematic diagram showing an example of an entry screen displayed on the first display 34*a*. As shown in FIG. 6, the user can operate the first input unit 35*a* and input into the first display 34*a* a setting angle when the trim angle control is performed. The setting angle when the trim angle control is performed refers to an angle that the propeller shaft 17*a* defines with the horizontal direction when the trim angle control is being performed. The setting angle when the trim angle control is performed includes a value equal to or greater than 0°. In the watercraft 1 according to the present preferred embodiment, the transom 2*a* projects rearwards. Therefore, setting the setting angle to an angle $\alpha$ (see FIG. 3) greater than 0° causes the trim angle control to function in an effective manner. In contrast, in a watercraft in which the transom 2*a* does not project rearwards, there may be instances in which a trim angle control is not particularly effective. In such an instance, the setting angle may be 0°. Thus, in the S-engine 3*a* according to the present preferred embodiment, initial setting of the trim angle control can be performed in accordance with the type of hull to which the S-engine 3*a* is attached.

The first ECU 31*a* that is initially set as described above determines, in an instance in which the command signal from the controller 8 includes the reverse signal, i.e., that the operation signal from the remote control device 6 indicates a reverse movement, and that the propeller shaft 17*a* is to rotate in the direction in which the hull 2 is propelled in reverse.

The first ECU 31*a* also determines, in an instance in which the joystick activation signal is received from the controller 8, i.e., in an instance in which the joystick 7 has been activated, that the propeller shaft 17*a* is to rotate in the direction in which the hull 2 is propelled in reverse. In other words, the first ECU 31*a* determines that the propeller shaft 17*a* is to rotate in the direction in which the hull 2 is propelled in reverse, not only in an instance in which the propeller shaft 17*a* has been switched to the reverse direction, but also in an instance in which the joystick 7 has been activated. The first ECU 31*a* is programmed to then cause the first PTT device 20*a* to perform a trim angle control. The body of the S-engine 3*a* is thus pivotably driven by the first PTT device 20*a* until the drive shaft 16*a* defines an angle $\alpha$ (see FIG. 3) with the vertical direction. As a result, the rear end portion $\mathbf{17}a_2$ of the propeller shaft 17*a* is disposed higher than the front end portion $\mathbf{17}a_1$.

The first ECU 31*a* causes the first PTT device 20*a* to disengage the trim angle control in an instance in which the reverse signal is no longer included in the command signal from the controller 8 or in an instance in which the joystick activation signal is no longer received from the controller 8, after execution of the trim angle control has been started. The body of the S-engine 3*a* is thus pivotably driven by the first PTT device 20*a* until the drive shaft 16*a* is parallel or substantially parallel to the horizontal direction. As a result, the rear end portion 17$a_2$ of the propeller shaft 17*a* is disposed at the same position in the vertical direction as the front end portion 17$a_1$.

The P-engine 3*b* includes a second electric control unit (ECU) 31*b*, a second shift actuator 32*b*, a second steering actuator 33*b*, a second display 34*b*, a second input unit 35*b*, a second engine 12*b*, and a second PTT device 20*b*. The C-engine 3*c* includes a third electrical control unit (ECU) 31*c*, a third shift actuator 32*c*, a third steering actuator 33*c*, a third display 34*c*, a third input unit 35*c*, a third engine 12*c*, and a third PTT device 20*c*. The configurations and functions of each of the P-engine 3*b* and the C-engine 3*c* are similar to the configurations and functions of the S-engine 3*a* described above, and a detailed description will not be provided. With regards to the S, P, and C-engines 3*a* through 3*c*, trim angle control, steering, and switching between forward and reverse movements can be performed independently of each other. In FIG. 5, mutually corresponding instruments in the S, P, and C-engines 3*a* through 3*c* are identified by identical numerals.

The first ECU 31*a* (an example of a control device) according to the present preferred embodiment is programmed so that the first ECU 31*a* can set the action of the first PTT device 20*a* in an instance in which the hull 2 is propelled in reverse. The first ECU 31*a* is programmed to cause the first PTT device 20*a* to perform the trim angle control in an instance in which the first ECU 31*a* determines that the propeller shaft 17*a* is to rotate in the direction in which the hull 2 is propelled in reverse.

Therefore, the first PTT device 20*a* is programmed to cause the rear end portion 17$a_2$ of the propeller shaft 17*a* to be disposed higher than the front end portion 17$a_1$. Thus, it is possible for the rotation of the propeller 13*a* to generate a water flow oriented forwards and diagonally downwards. Accordingly, the water flow generated by the propeller 13*a* is prevented from striking the transom 2*a* of the hull 2.

The first ECU 31*a* according to the present preferred embodiment causes the first PTT device 20*a* to perform a trim angle control in an instance in which the joystick mode button 7*a* has been activated. In other words, the first ECU 31*a* is programmed to cause the first PTT device 20*a* to perform the trim angle control in an instance in which the S-engine 3*a* (an example of an outboard motor) is controlled in accordance with the operation signal from the joystick 7.

Therefore, in an instance in which the watercraft can be maneuvered using the joystick 7, a preparation is made, without waiting for an operation signal from the joystick 7, to generate a water flow oriented forwards and diagonally downwards. Therefore, in an instance in which the user operates the joystick 7 and causes the hull 2 to move in reverse, it is possible to promptly generate the wafer flow oriented forwards and diagonally downwards The first ECU 31*a* according to the present preferred embodiment can be set with a setting angle, during the trim angle control, between the propeller shaft 17*a* and the horizontal direction.

Therefore, the operator is able to set, as desired, the setting angle, i.e., the extent by which the propeller shaft 17*a* is inclined, when the trim angle control is performed.

The S-engine 3*a* according to the present preferred embodiment includes the first display 34*a* to display the entry screen to set the first ECU 31*a*, and the first input unit 35*a* to input the setting angle when the trim angle control is performed.

Therefore, the operator can set the setting angle in a simple manner when the trim angle control is performed.

Although the present invention has been described with respect to the above-described preferred embodiments, the description and drawings forming a part of this disclosure shall not be construed as being by way of limitation to the presented invention. A variety of alternative preferred embodiments, examples, and operational techniques shall be evident to those skilled in the art from this disclosure.

In the above-described preferred embodiments, the first ECU 31*a* preferably determines that the propeller shaft 17*a* is to rotate in reverse in an instance in which the command signal from the controller 8 includes the reverse signal, i.e., in an instance in which the operation signal from the remote control device 6 indicates a reverse movement. However, this is not provided by way of limitation. For example, in an instance in which the S-engine 3*a* includes a sensor to detect the position of the dog clutch 24*a*, the first ECU 31*a* may determine that the propeller shaft 17*a* is to rotate in reverse in an instance in which the dog clutch 24*a* is positioned at a reverse propulsion position.

Also, in the above-described preferred embodiments, the first ECU 31*a* preferably determines the propeller shaft 17*a* is to rotate in reverse in an instance in which the joystick activation signal is received from the controller 8, i.e., in an instance in which the joystick 7 has been activated. However, this is not provided by way of limitation. It is possible for the controller 8 to not send the joystick activation signal in an instance in which the joystick 7 has been activated. In such an instance, the first ECU 31*a* may determine the propeller shaft 17*a* is to rotate in reverse in an instance in which the operation signal from the joystick 7 indicates that the propeller shaft 17*a* is to rotate in the direction in which the hull 2 is propelled in reverse. In such an instance, the trim angle control is performed not only when the hull 2 is propelled in reverse but also when the propeller shaft 17*a* is caused to rotate in reverse in order to cause the hull 2 to move rightwards or leftwards.

In the above-described preferred embodiments, the angle $\alpha$ defined between the propeller shaft 17*a* and the horizontal direction when the trim angle control is performed is smaller than the range within which the body of the S-engine 3*a* is pivotably driven by the pair of trim cylinders 25 (i.e., the maximum trim angle). However, this is not provided by way of limitation. The angle $\alpha$ need only be set within the range within which the body of the S-engine 3*a* is pivotably driven by the tilt cylinder 26 (i.e., the maximum tilt angle).

Although no particular description was given in the above-described preferred embodiments, the S, P, and C-engines 3*a* through 3*c* may perform the trim angle control in coordination with each other. In other words, in an instance in which the trim angle control is performed in relation to any one of the S, P, and C-engines 3*a* through 3*c*, a trim angle control may also be performed for another outboard motor for which it has not been determined that the propeller shaft is to rotate in the direction in which the hull 2 is propelled in reverse.

In the above-described preferred embodiments, the controller 8 preferably is provided independent from other devices on the watercraft 1. However, the controller 8 may be included with another device. For example, the controller 8 may be included in the steering device 5.

In the above-described preferred embodiments, the watercraft 1 is preferably provided with the joystick 7. However, this is not provided by way of limitation. The watercraft 1 may be configured to not include the joystick 7, or may be provided with a track ball or a touch-panel type display device instead of the joystick 7.

In the above-described preferred embodiments, a hydraulic cylinder is shown as an example of the first through third steering actuators 33*a* through 33. However, another actuator may be used. For example, each of the first through third steering actuators 33*a* through 33*c* may be an actuator including an electric motor. The first through third shift actuators 32*a* through 32*c* are not limited to an electrical cylinder, and other actuators may be used. For example, each of the first through third shift actuators 32*a* through 32*c* may be an actuator including a hydraulic cylinder or an electric motor.

In the above-described preferred embodiments, in an instance in which the hull 2 is moving forward, the drive shaft 16*a* is parallel or substantially parallel to the vertical direction and the axial line direction Ax3*a* of the propeller shaft 17*a* is parallel or substantially parallel to the horizontal direction. However, this is not provided by way of limitation. Even in an instance in which the hull 2 is moving forward, the drive shaft 16*a* may be inclined at a predetermined angle relative to the vertical direction. The predetermined angle may be larger than the setting angle when the trim angle control is performed (angle α shown in FIG. 3), or may be smaller than the setting angle when the trim angle control is performed. A trim switch may be provided near the maneuvering seat 4 for the user to operate in order to set the predetermined angle of the hull 2.

In the above-described preferred embodiments, in an instance in which the first PTT device 20*a* disengages the trim angle control, the body of the S-engine 3*a* is pivotably driven until the angle α is equal to 0° (see FIG. 2). However, in an instance in which a setting has been made so that the drive shaft 16*a* is inclined at a predetermined angle even in an instance in which the hull 2 is moving forward, the first PTT device 20*a* may, in response to the trim angle control being disengaged, pivotably drive the body of the S-engine 3*a* until the drive shaft 16*a* is inclined at the predetermined angle. Also, in an instance in which a setting has been made so that the drive shaft 16*a* is inclined in an instance in which the hull 2 is moving forward, the first PTT device 20*a* may, in response to the trim angle control being disengaged, maintain the angle α without pivotably driving the body of the S-engine 3*a*.

Although no particular description was given in the above-described preferred embodiments, the first ECU 31*a* may direct the first PTT device 20*a* to change the setting angle when the trim angle control is performed according to a rotation angle of the body of the S-engine 3*a* about the steering axis Ax2*a* (i.e., steering angle). Specifically, in case of a V-type bottom of the watercraft, the water flow during a reverse movement becomes easy to strike the rear surface of the bottom of the transom as the S-engine 3*a* is steered in a toe-in direction. Therefore, in such an instance, it is preferred that the setting angle is set to a low angle when the steering angle is zero (i.e., the water flows straight ahead) and the setting angle is set to a high angle when the S-engine 3*a* is steered in a toe-in direction (i.e., the water flows toward the V-type bottom of the transom). As a result, it is possible to increase the force propelling the watercraft when the steering angle is zero and to prevent water flow from striking the bottom of the transom by inclining the water flow obliquely downward when the water flow is likely to strike the bottom of the transom by reason that the steering angle is high.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An outboard motor attached to a hull, the outboard motor comprising:

a body including an engine and a propeller shaft that is rotated by a drive force from the engine, the body configured to pivot about a tilt axis extending in a lateral direction of the hull;

a body driving device configured to drive the body about the tilt axis; and a control device programmed to control the body driving device so that a rear end of the propeller shaft is positioned higher than a front end of the propeller shaft when the control device determines that the propeller shaft is to rotate in a direction in which the hull is propelled in reverse.

2. The outboard motor according to claim 1, wherein the control device is programmed to control the body driving device so that the rear end of the propeller shaft is positioned higher than the front end of the propeller shaft when the control device controls the outboard motor according to an operation signal from a joystick, the joystick used to select propelling the hull at least in forward, reverse, leftward, and rightward directions.

3. The outboard motor according to claim 1, wherein the control device is programmed to set a setting angle of the propeller shaft in relation to a horizontal direction when controlling the body driving device so that the rear end of the propeller shaft is positioned higher than the front end of the propeller shaft.

4. The outboard motor according to claim 3, further comprising:

a display configured to display an entry screen to set the control device; and an input unit used to input the setting angle.

5. The outboard motor according to claim 1, wherein the body further includes a drive shaft connected to the engine, and a shift mechanism connected to the propeller shaft, the shift mechanism configured to transmit a rotary drive force of the drive shaft to the propeller shaft;

the shift mechanism includes a dog clutch configured to move between a reverse propulsion position and a forward propulsion position, the shift mechanism being engaged with the propeller shaft to rotate in a direction in which the hull is propelled in reverse when the shift mechanism is positioned in the reverse propulsion position, the shift mechanism being engaged with the propeller shaft to rotate in a direction in which the hull is propelled forward when the shift mechanism is positioned in the forward propulsion position; and the control device is programmed to determine that the propeller shaft is to rotate in a direction in which the hull is propelled in reverse when the shift mechanism is positioned in the reverse propulsion position.

6. The outboard motor according to claim 1, wherein the control device is programmed to determine that the propeller shaft is to rotate in a direction in which the hull is propelled in reverse when an operation signal sent from a remote control indicates a reverse movement of the hull, the remote control used to select propelling the hull forward and in reverse.

7. The outboard motor according to claim 1, wherein the control device is programmed to determine that the propeller shaft is to rotate in a direction in which the hull is propelled in reverse when an operation signal sent from a joystick indicates a reverse movement of the hull, the joystick used to select propelling the hull at least in forward, reverse, leftward, and rightward directions.

8. The outboard motor according to claim 1, wherein the body is configured to pivot about a steering axis parallel to a direction perpendicular or substantially perpendicular to the tilt axis; and the control device is programmed to direct the body driving device to change a setting angle of the propeller shaft in relation to a horizontal direction according to a rotation angle of the body about the steering axis when the body driving device positions the rear end of the propeller shaft higher than the front end of the propeller shaft.

* * * * *